US006092478A

United States Patent [19]

Simakrai et al.

[11] Patent Number: 6,092,478

[45] Date of Patent: Jul. 25, 2000

[54] APPARATUS AND METHOD FOR MONITORING CONSUMPTION OF SEWING THREAD SUPPLY

[75] Inventors: Khun Niphant Simakrai, Bangplee; Khun Thavorn Phienvech, Bangkapi, both of Thailand

[73] Assignee: The Singer Company NV, Curacao, Netherlands Antilles

[21] Appl. No.: 09/417,568

[22] Filed: Oct. 14, 1999

[51] Int. Cl.[7] ..... D05B 45/00

[52] U.S. Cl. ..... 112/278; 112/470.04; 112/475.01; 242/563

[58] Field of Search ..... 112/278, 273, 112/470.01, 470.04, 475.01; 242/563; 66/163; 57/81; 340/677

[56] References Cited

U.S. PATENT DOCUMENTS

| | | | |
|---|---|---|---|
| 3,928,752 | 12/1975 | Darwin . | |
| 4,192,243 | 3/1980 | Blessing et al. . | |
| 4,766,827 | 8/1988 | Matsubara . | |
| 5,018,465 | 5/1991 | Hager et al. . | |
| 5,020,461 | 6/1991 | Hanyu et al. . | |
| 5,161,475 | 11/1992 | Tawara et al. . | |
| 5,322,028 | 6/1994 | Hashiride et al. | 112/278 |
| 5,322,029 | 6/1994 | Fujita . | |
| 5,339,758 | 8/1994 | Fujita . | |
| 5,350,127 | 9/1994 | Arnold et al. . | |
| 5,842,432 | 12/1998 | Wakasugi . | |
| 6,012,405 | 1/2000 | Melton et al. | 112/475.01 |

FOREIGN PATENT DOCUMENTS

| | | |
|---|---|---|
| 2600085 | 12/1987 | France . |
| 4024989 | 5/1991 | Germany . |
| 4210477 | 10/1992 | Germany . |
| 62-186893 | 8/1987 | Japan . |
| 8057180 | 3/1996 | Japan . |
| 8084882 | 4/1996 | Japan . |
| 8168582 | 7/1996 | Japan . |
| 9024174 | 1/1997 | Japan . |
| 9056961 | 3/1997 | Japan . |

*Primary Examiner*—Peter Nerbun
*Attorney, Agent, or Firm*—Cummings & Lockwood

[57] ABSTRACT

An apparatus for monitoring consumption of a supply of thread includes entry keys for allowing a user to input an initial supply of thread, and a minimum allowable supply of thread, and a detector for providing signals indicative of the rate of thread consumption. The apparatus also includes a control circuit for receiving the initial supply, the minimum allowable supply, and the signal indicative of the rate of thread consumption. The control circuit then calculates a consumed amount of thread and an actual supply of thread remaining, and produces a display signal indicative of the actual supply and/or the consumed amount, and an alarm when the actual supply of thread is equal to or less than the minimum allowable supply. The apparatus further includes a display panel for displaying the actual supply and the consumed amount upon receipt of the display signal from the control circuit.

22 Claims, 5 Drawing Sheets

APPARATUS AND METHOD FOR MONITORING CONSUMPTION OF SEWING THREAD SUPPLY

BACKGROUND OF THE INVENTION

The present disclosure generally relates to an apparatus and method for monitoring consumption of sewing thread by a stitch-forming machine and, more particularly, to an apparatus and method for providing a warning of an impending depletion of a supply of sewing thread. Even more particularly, the present disclosure generally relates to an apparatus and method for collecting data on the consumption of sewing thread by a stitch-forming machine.

In the sewing industry, it is often desirable to know the amount of thread being consumed by a stitch forming machine, such as a sewing machine, since the consumption of thread can be, for example, an indication of the quality of seams produced and the efficiency of a large scale sewing process, such as in a garment factory. It is also desirable to know when a supply of thread, e.g., a bobbin of thread, is about to run out, since running out of thread without warning while sewing is at the very least an inconvenience. Furthermore, the unexpected loss of thread while sewing a seam can require the removal and replacement of the unfinished seam, and could even result in a defectively sewn product.

Some previously existing devices for measuring thread consumption included mechanical measuring devices and a meter or other display for measuring and displaying the total amount of thread consumed. However, one drawback associated with such devices is that they do not provide an alarm for warning of an impending depletion of the thread supply. Preferably, an apparatus for measuring thread consumption will provide an alarm for warning of an impending depletion of the thread supply.

A number of devices for measuring thread consumption do include a low thread supply alarm. U.S. Pat. No. 5,339,758, for example, provides such a device. Many of these devices, however, such as that disclosed in U.S. Pat. No. 5,339,758, measure thread consumption by monitoring the rotation of the bobbin itself. However, quite a few types of sewing machines draw thread from bobbins without actual rotation of the bobbins. Accordingly, an apparatus for measuring thread consumption will preferably measure thread consumption independently of the rotation of the bobbin, such that it can be used with sewing machines that do not utilize rotating bobbins.

It is also desirable to provide a thread consumption monitoring apparatus that allows a user to enter an initial amount of thread on a bobbin and a minimum allowable amount of thread to remain on the bobbin. Preferably, the apparatus will store the overall total amount of thread consumed and allow a user to access that information. In addition, the apparatus will preferably store the total number of bobbins emptied by the sewing machine and allow a user to access that information.

Furthermore, it is desirable to provide an apparatus for monitoring thread consumption that allows a user to select between a count-up mode, wherein the displayed thread amount begins at zero and the thread consumption progresses up towards the initial amount of thread, and a count-down mode, wherein the displayed thread consumption begins at the initial amount of thread and progresses down towards zero. Furthermore, the apparatus will preferably allow a user to pause the consumption monitoring, in the event, for example, of thread breakage.

SUMMARY OF DISCLOSURE

Accordingly, the present disclosure provides an apparatus for monitoring consumption of a supply of sewing thread including first means for allowing a user to input an initial supply of thread and a minimum allowable supply of thread, and second means for providing at least one signal indicative of a rate of thread consumption. The apparatus also includes third means for receiving the initial supply and the minimum allowable supply, and the signal indicative of the rate of thread consumption.

The third means then calculates a consumed amount of thread based upon the signal indicative of the rate of thread consumption, and an actual supply of thread remaining on the bobbin based upon the consumed amount and the initial supply of thread. The third means then produces a display signal indicative of at least one of the actual supply and the consumed amount, and produces an alarm when the actual supply of thread is equal to or less than the minimum allowable supply of thread.

The apparatus further includes fourth means for displaying at least one of the actual supply and the consumed amount of thread upon receiving the display signal from the third means.

According to one aspect of the present disclosure, the third means also stores a total amount of consumed thread.

According to another aspect of the present disclosure, the supply of thread is produced from a bobbin, and the third means also stores a number of bobbins used and increases the number of bobbins used each time a user inputs an initial supply of thread.

According to an additional aspect of the present disclosure, the first means further allows a user to reset to zero each of the total consumed amount of thread and the number of bobbins used.

According to a further aspect of the present disclosure, the first means allows a user to input a pause command, and the third means stops calculating the consumed amount of thread when the pause command is received from the first means.

According to still another aspect of the present disclosure, the thread is supplied from a bobbin, and the second means for providing a signal indicative of the rate of thread consumption is independent of rotation of the bobbin from which the thread is supplied.

According to one aspect of the present disclosure, the second means for providing a signal indicative of the rate of thread consumption includes a detector for detecting thread movement, or for detecting movement of a target corresponding to or otherwise indicative of thread movement.

According to another aspect of the present disclosure, the second means for providing a signal indicative of the rate of thread consumption includes a rotatable pulley for receiving the thread, means for placing the thread under tension on the pulley such that the pulley rotates as the thread is consumed, an encoding wheel for rotating as the pulley rotates, and a detector mounted adjacent to the encoding wheel for providing a signal indicative of the rate of thread consumption based upon the rotation of the encoding wheel.

The present disclosure also provides a method for monitoring consumption of a supply of sewing thread. The method includes receiving signals indicative of an initial supply of thread, a minimum allowable supply of thread, and a rate of thread consumption. A consumed amount of thread is then calculated based upon the rate of thread consumption, and an actual supply of thread is calculated based upon the consumed amount and the initial supply of thread. The method further includes producing a display signal indicative of at least one of the consumed amount and the actual supply, and a warning when the actual supply of thread is approximately equal to or less than the minimum allowable supply.

BRIEF DESCRIPTION OF DRAWINGS

The disclosure will be better understood upon reading the following description of the preferred embodiment in conjunction with the accompanying drawings, wherein.

DETAILED DESCRIPTION OF DISCLOSURE

Figure 1:
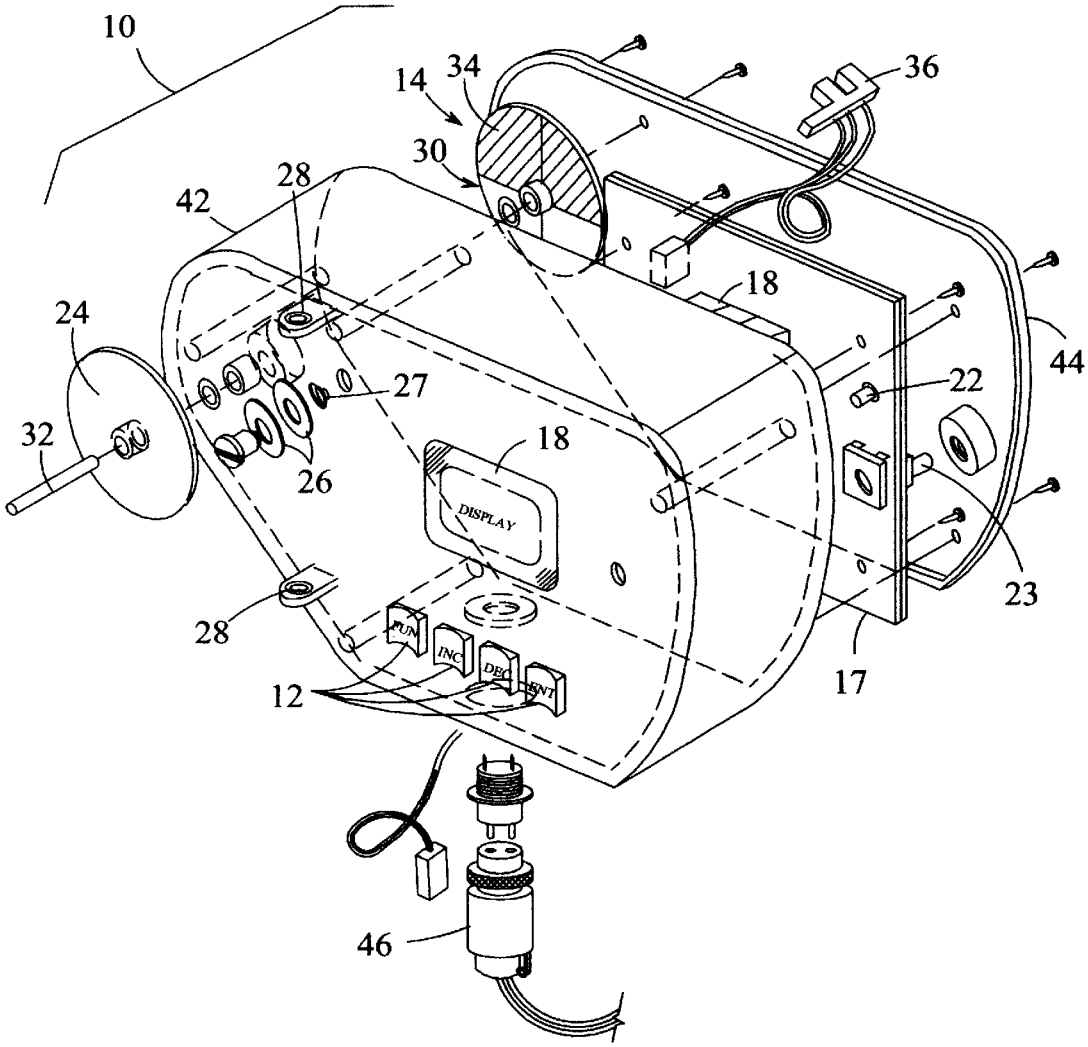
FIG. 1 is an exploded front perspective view of an apparatus according to the present disclosure for monitoring thread supply consumption.
Figure 2:
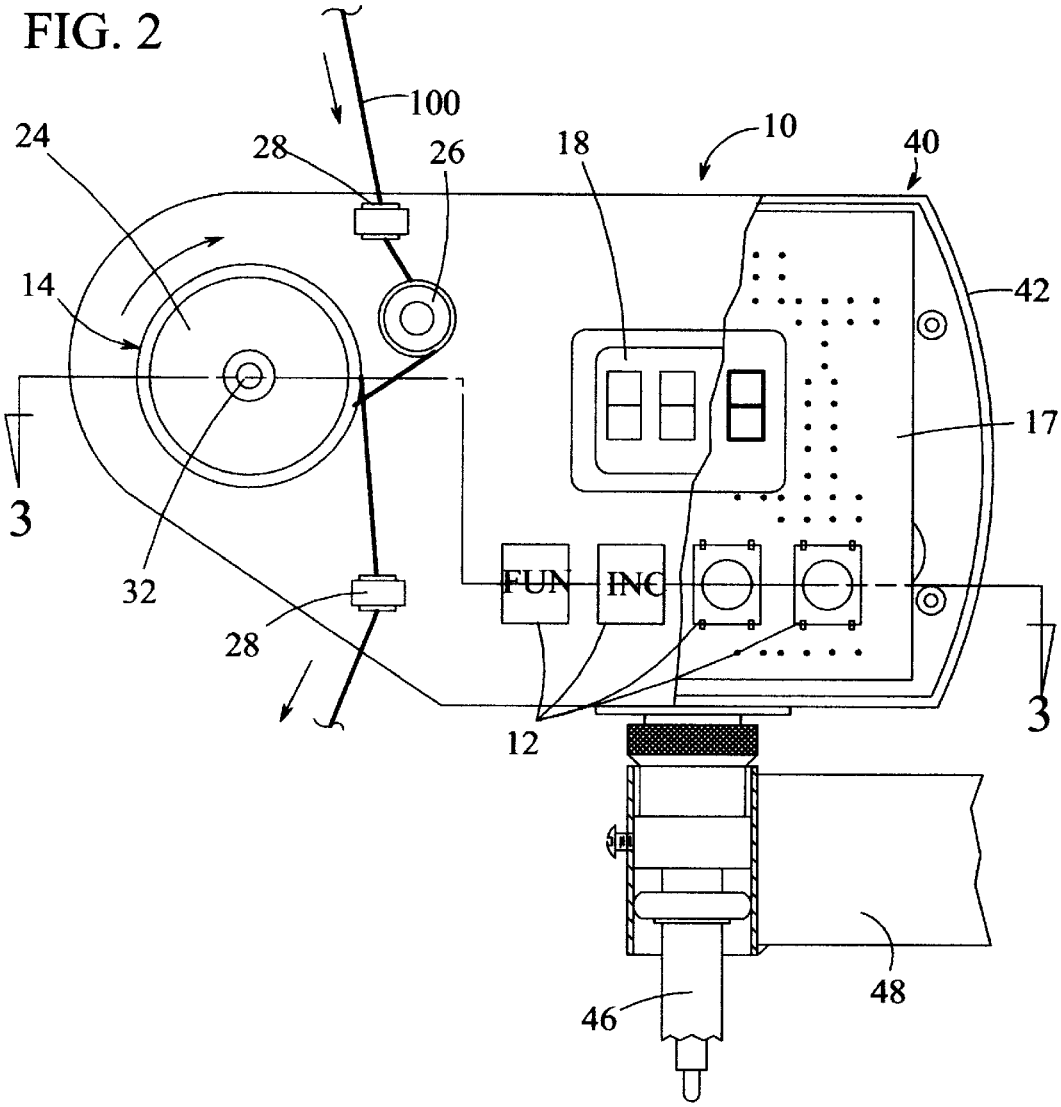
FIG. 2 is a front elevation view, partially cut-away, of the apparatus of FIG. 1, a pulley of the apparatus is shown receiving a thread.

Referring to FIGS. 1 through 8, the present disclosure provides an apparatus and method for monitoring consumption of a supply of thread. The apparatus, generally designated by the reference numeral 10, is particularly suitable for use with stitch-forming machines, such as sewing machines, using thread supplied from a bobbin or other thread-supplying device. Accordingly, as shown in FIG. 2, a thread 100 is received by the apparatus 10 from a bobbin or like device (not shown).

Figure 4:
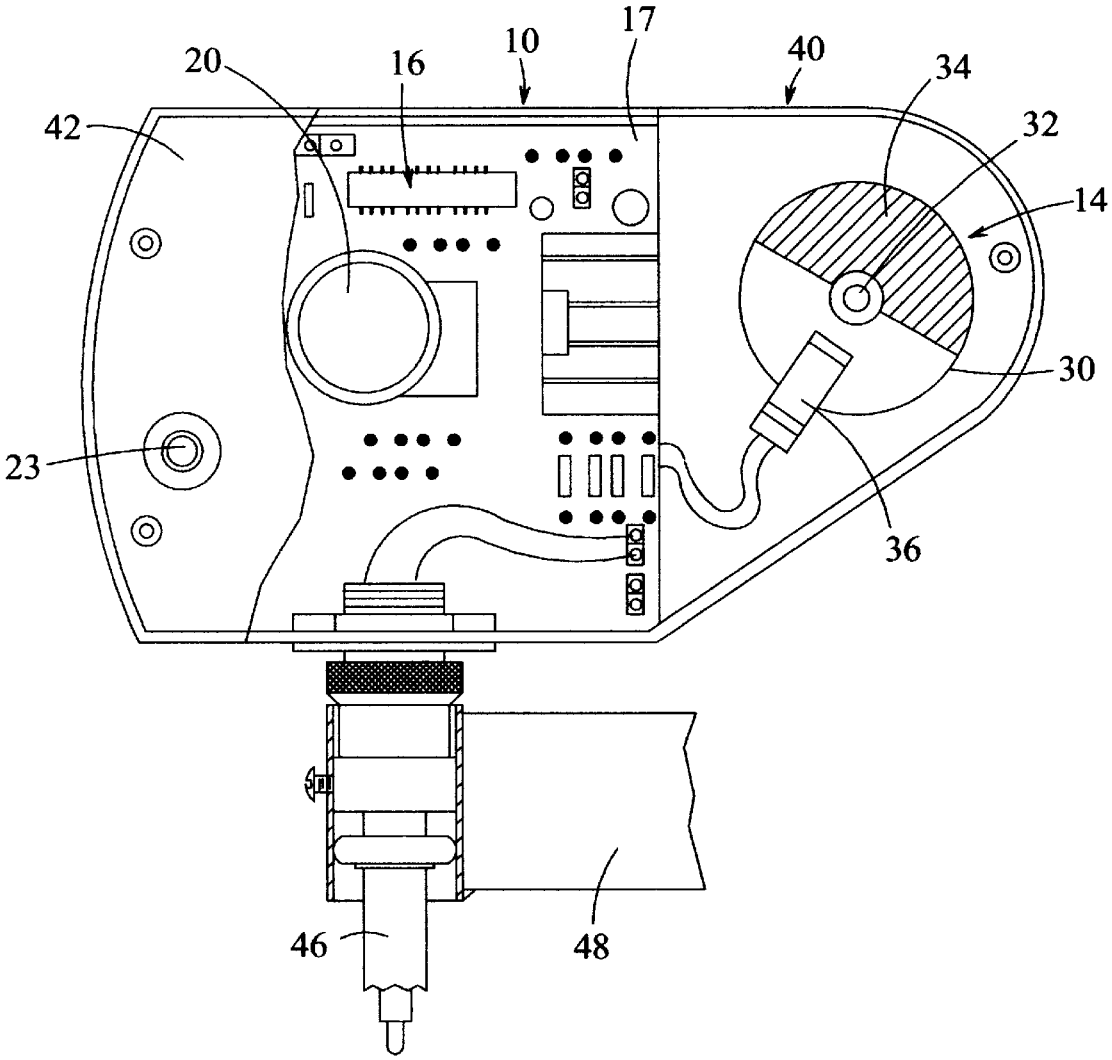
FIG. 4 is a rear elevation view, partially cut-away, of the apparatus of FIG. 1.
Figure 8:
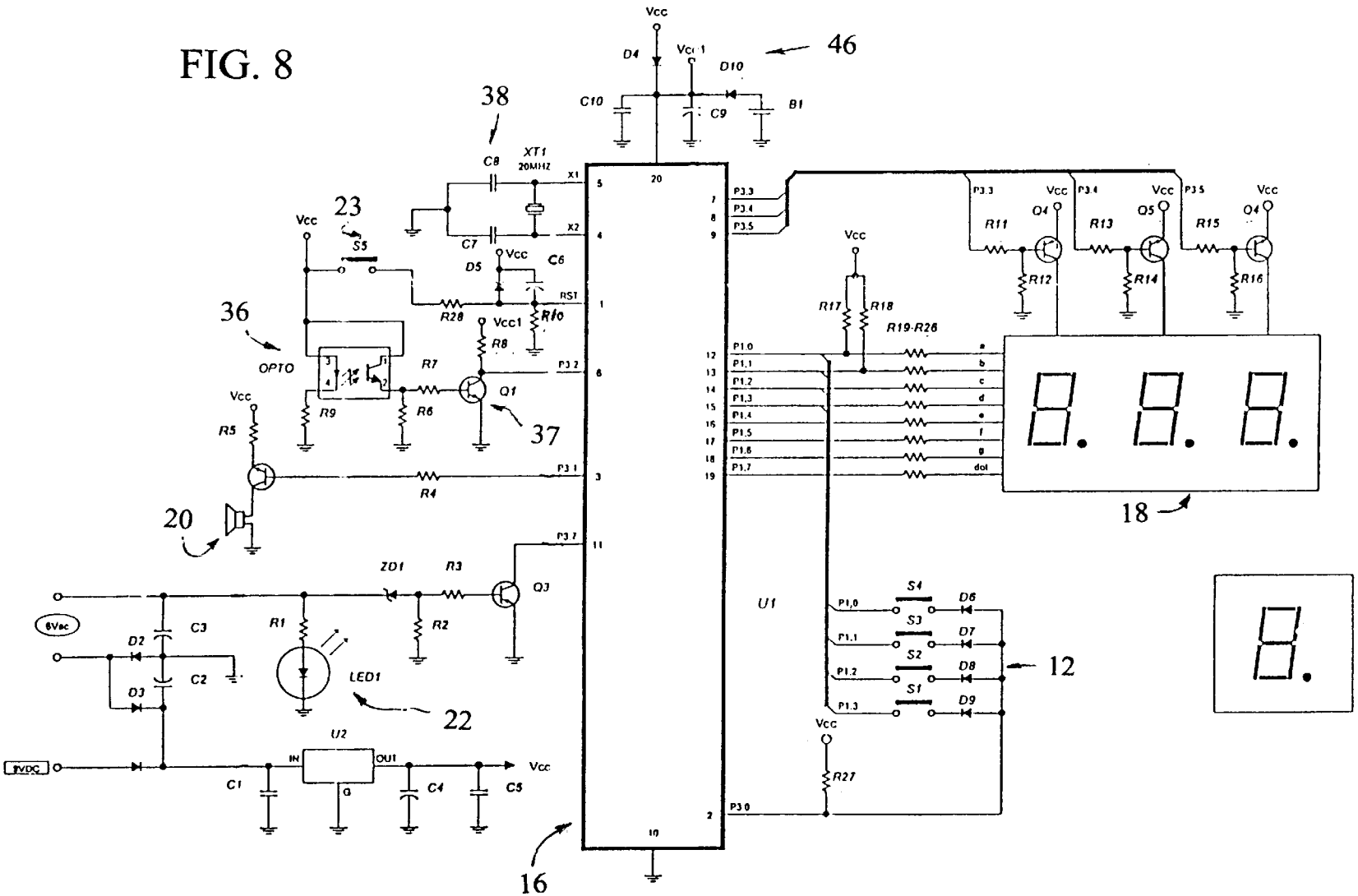
FIG. 8 is an electrical schematic of the apparatus of FIG. 1.

The apparatus 10 generally includes first means 12 for allowing a user to input an initial supply of thread and a minimum allowable supply of thread, and second means 14 for providing at least one signal indicative of a rate of thread consumption. As shown in FIGS. 4 and 8, a third means in the form of a control circuit 16 is included for receiving the initial supply and the minimum allowable supply of thread from the first means 12, and the signal indicative of the rate of thread consumption from the second means 14.

The control circuit 16 calculates (i) a consumed amount of thread based upon the signal indicative of the rate of thread consumption, and (ii) an actual supply of thread remaining based upon the consumed amount and the initial supply of thread. With these calculations, the control circuit 16 produces a display signal indicative of at least one of the actual supply and the consumed amount of thread, and an alarm signal when the actual supply of thread is approximately equal to or is less than the minimum allowable supply of thread.

As may be recognized by those of ordinary skill in the pertinent art based on the teachings herein, the control circuit 16 may take the form of any of numerous different electronic processors, microprocessors or other integrated circuit devices which are currently or later become known or commercially available for performing the functions of the control circuit 16 described herein. A preferred control circuit 16 is an 8-Bit micro controller, with 2K Bytes of flash memory, available as model number AT89C2051 from Atmel Corporation, of San Jose, Calif., (www.atmel.com). The electrical schematic of FIG. 8 shows how the micro controller 16 is preferably connected to other components of the apparatus 10. This electrical schematic is embodied in the printed circuit board 17 shown in FIGS. 1 through 4.

As shown in FIGS. 1 and 2, the apparatus 10 further includes fourth means 18 for displaying at least one of the actual supply and the consumed amount of thread upon receiving the display signal from the control circuit 16. As shown in FIG. 8, the apparatus 10 further includes fifth means 20 for providing a warning signal upon receiving the alarm signal from the control circuit 16. As shown, the fourth means comprises a multi-digit LED display panel 18, while the fifth means comprises an audible alarm, such as a buzzer 20. It should be understood, however, that the fourth means may take the form of any of numerous different types of visual displays that currently, or later become known for performing the function of the fourth means as described herein. Similarly, the fifth means 20 could alternatively, or in addition, comprise a visual or other suitable alarm, such as a blinking light.

Preferably, the control circuit 16 of the presently disclosed apparatus 10 also stores a total consumed amount of thread and, if the apparatus is used with a bobbin-supplied thread, the total number of bobbins depleted. The control circuit 16 increases the number of bobbins depleted by one each time a user inputs an initial supply of thread using the first means 12.

Preferably, the first means 12 additionally allows a user to input a pause command such that the control circuit 16 temporarily stops calculating the amount of thread consumed when the pause command is received. The first means 12 preferably further allows a user to input at least one of a count-up command and a count-down command. The control circuit 16 is programmed to, in turn, produce a display signal indicative of the consumed amount of thread upon receipt of the count-up command, and a display signal indicative of the actual supply of thread upon receipt of the count-down command.

As shown in FIGS. 1 and 2, the first means comprises a plurality of user input or entry keys 12 bearing indicia describing or referring to their respective functions. In particular, the entry keys include a function key (labeled "FUN") for selecting the function desired, an up key (labeled "INC") for increasing the displayed number, a down key (labeled "DEC") for decreasing the displayed number, and an enter key (labeled "ENT") for entering the function or number selected. In the illustrated embodiment of the apparatus 10, the entry keys 12, in conjunction with the control circuit 16, operate in the following manner:

When the apparatus is operating or "turned on", the display panel 18 shows "SEL", i.e. select;

Pressing the function ("FUN") key once will cause the display panel 18 to show "F-1" or other suitable indicia, which is the sewing mode. The apparatus 10 is provided with an LED 22 that is turned on by the control circuit 16 during the sewing mode. In case of thread breakage, the enter ("ENT") key can be pressed to pause the monitoring of the thread consumption, wherein the LED 22 will be turned off by the control circuit 16. Pressing the enter ("ENT") key again will resume monitoring, wherein the LED 22 will be turned on;

Pressing the function ("FUN") key twice will cause "F-2" or other suitable indicia to be displayed, whereupon the count-up or the count-down command can be entered by using the up ("INC") and down ("DEC") keys and the enter ("ENT") key;

Pressing the function ("FUN") key three times will cause "F-3" or other suitable indicia to be displayed, wherein the initial thread supply can be entered by using the up ("INC") and down ("DEC") keys and the enter ("ENT") key;

Pressing the function ("FUN") key four times will cause "F-4" or other suitable indicia to be displayed, wherein the minimum thread supply can be entered by using the up ("INC") and down ("DEC") keys and the enter ("ENT") key;

Pressing the function ("FUN") key five times will cause the total number of bobbins used to be displayed;

Pressing the function ("FUN") key six times will cause the total amount of thread consumed to be displayed; and Pressing the function ("FUN") key seven times will cause "DEL" or other suitable indicia to flash on the display panel. If the enter ("ENT") key is then pressed, the values previously entered will be reset to zero.

As may be recognized by those of ordinary skill in the pertinent art based on the teachings herein, the first means may take a form other than user input or entry keys 12. The first means could comprise any of numerous input devices which are currently or later become known or commercially available for allowing a user to make a selection and enter data including, by not limited to, input buttons, a separate keyboard or a mouse.

As shown in FIG. 4, the apparatus 10 also includes a recessed "reset" button 23 on a rear side of the apparatus 10. Pressing the reset button 23 will reset to zero any values stored by the control circuit 16 for the total bobbins used and the total amount of thread consumed.

Preferably, the amount and supply of thread is measured, recorded and displayed as a measurement of thread length, e.g., in meters or yards.

If the apparatus 10 is used with a bobbin-supplied thread, the second means 14 preferably provides a signal indicative of the rate of thread consumption independently of whether the bobbin rotates while the thread is consumed. This is beneficial and preferred since some stitch-forming machines retrieve thread from bobbins without rotating the bobbins.

Figure 3:
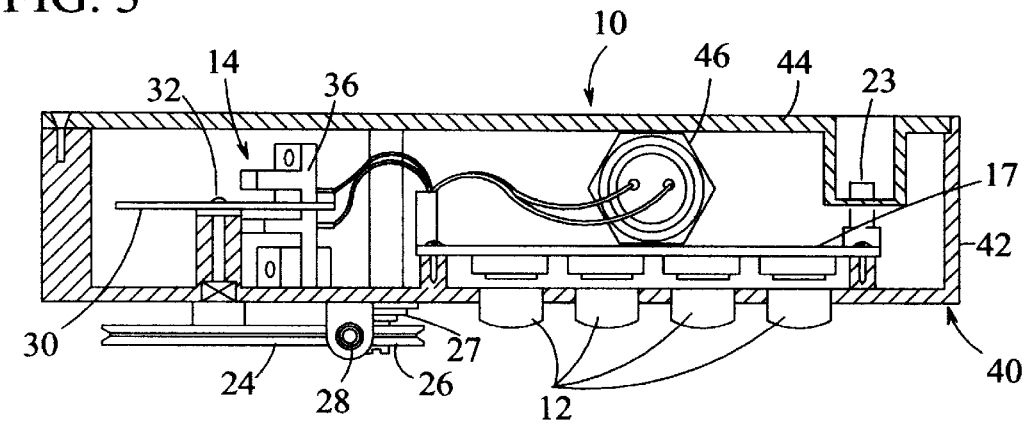
FIG. 3 is a sectional view of the apparatus of FIG. 1 taken along line 3—3 of FIG. 2.

Accordingly, as shown best in FIGS. 1 and 3, the second means comprises an encoding wheel assembly 14 which operates independently of bobbin rotation. A rotatable pulley 24 is rotatably mounted on the front of the apparatus 10 for receiving the thread 100, and the encoding wheel assembly comprises an encoding wheel 30 keyed or otherwise fixedly secured on a common axle 32 with the pulley 24, such that the encoding wheel rotates with the pulley.

Figure 6:
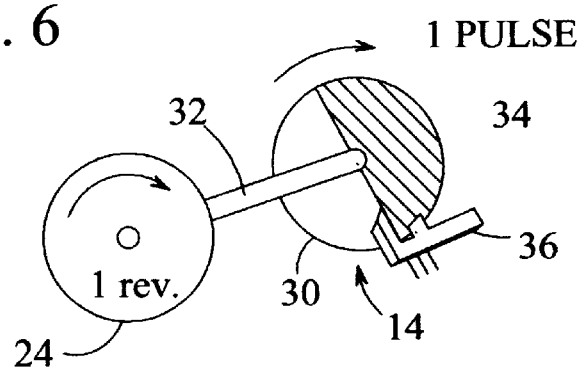

As shown in FIG. 1, the encoding wheel 30 includes at least one target 34 in the form of reflective material mounted on the wheel. As shown in FIGS. 3, 4 and 6, a detector in the form of an optical detector 36, is mounted adjacent to and receives the encoding wheel 30 and transmits a signal to the control circuit 16 each time the target 34 passes the detector.

Figure 5:
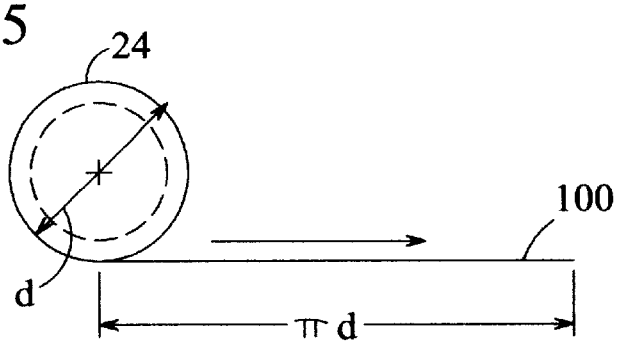
FIGS. 5 through 7 are schematic representations illustrating how the apparatus of FIG. 1 calculates thread consumption based upon rotation of the pulley receiving the thread.

Referring in particular to FIGS. 5 and 6, since the encoding wheel 30 includes one target 34, the detector 36 provides one signal or pulse for each rotation of the encoding wheel. Thus, the measured length of the thread 100 can be calculated using the equation $L=n\pi d$, where L is the total length of the thread, d is the diameter of the encoding wheel 30, and n is the number of signals produced by the detector 36, where each signal corresponds to one revolution of the encoding wheel. In the particular embodiment shown, the diameter d of the pulley 24 is equal to approximately 3.183 centimeters, such that the total length of the thread L equals 0.1 meter times n, where "n" is the number of signals produced by the detector 36.

Figure 7:
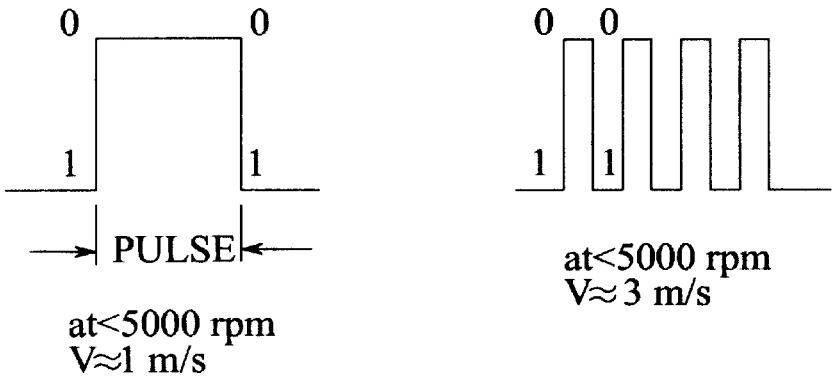

Referring to FIG. 8, the detector 36 is supplemented with circuitry 37 that converts analog signals from the detector into digital signals, as indicated typically by the pulse forms of FIG. 7, for use by the control circuit. In addition, if the number of pulses received from the detector is less than five thousand per minute (i.e., <5,000 rpm), the circuit 37 "tells" the control circuit 16 that the thread 100 is travelling through the apparatus 10 at a particular rate (e.g., one meter per second (1 m/s). If the number of pulses received from the detector is more than five thousand per minute (i.e., >5,000 rpm), the circuit 37 tells the control circuit 16 that the thread 100 is travelling through the apparatus 10 at another rate (e.g. five meters per second (5 m/s). The control circuit 16 can then use the speed of the thread 100 in combination with input from a standard oscillator or "clock" circuit 38 to calculate the total amount of thread consumed.

As may be recognized by those of ordinary skill in the pertinent art based on the teachings herein, the second means 14, including the encoding wheel 30 and the detector 36, may take the form of any of numerous encoding, sensing and/or detector devices which are currently or later become known or commercially available for sensing the length of thread moving through apparatus, or for sensing the rate of thread consumption, and generating signals indicative thereof, or which otherwise may perform the functions of the second means 14 as described herein.

As shown in FIGS. 1 and 2, a set of rotatably-mounted tension disks 26, which are biased together by a spring 27, are located adjacent to the thread entry point of the pulley for placing the thread on the pulley 24 under tension such that the pulley rotates as the thread is consumed. Eyelets 28 are also mounted on the opposite side of the tension disks 26 relative to the pulley 24 for guiding the thread 100 through the apparatus. It should be noted that a second, similar set of tension disks can be provided adjacent to the thread exit point of the pulley if desired.

As shown best in FIGS. 1 and 3, the apparatus 10 includes a housing 40 including a front portion 42 and rear plate 44. The apparatus 10 also includes an electric cord 46 for connection to an external power source. It is meant that the apparatus 10 can be provided as part of a newly manufactured thread-forming machine, or used as an after-market option for use with existing machines. As shown in FIGS. 2 and 4, a bracket 48 can also be provided for mounting the apparatus 10 on or near a thread-forming machine.

In summary, the present disclosure provides an apparatus for monitoring sewing thread consumption that: provides an alarm for warning of an impending depletion of the thread supply; provides thread consumption monitoring independent of bobbin rotation, such that it can be used with sewing machines that do not utilize rotating bobbins; allows a user to easily enter an initial supply of thread, and a minimum allowable supply of thread to remain on a bobbin or like thread supplying device; stores the overall total amount of thread consumed, and the total number of bobbins emptied by the sewing machine; allows a user to select between a count-up and a count-down mode; and allows a user to pause the consumption monitoring, in the event of thread breakage, for example.

Although the apparatus for monitoring consumption of thread supply according to the present disclosure has been described with respect to a preferred embodiment, it is apparent that modifications and changes can be made thereto without departing from the spirit and scope of the apparatus and method as defined by the appended claims.

What is claimed is:

1. An apparatus for monitoring consumption of a supply of sewing thread, comprising:

a) first means for allowing a user to input, i) an initial supply of thread, and ii) a minimum allowable supply of thread;

b) second means for providing at least one signal indicative of a rate of thread consumption;

c) third means for, i) receiving the initial supply and the minimum allowable supply from the first means, ii) receiving the signal indicative of the rate of thread consumption from the second means, iii) calculating a consumed amount of thread based upon at least the signal indicative of the rate of thread consumption, iv) calculating an actual supply of thread remaining based at least upon the consumed amount and the initial supply of thread, v) producing a display signal indicative of at least one of the actual supply and the consumed amount, and vi) producing an alarm signal when the actual supply of thread is approximately equal to or less than the minimum allowable supply of thread; and d) fourth means for displaying at least one of the actual supply and the consumed amount of thread upon receiving the display signal from the third means.

2. The apparatus of claim 1 wherein the third means also stores a total amount of consumed thread.

3. The apparatus of claim 2 wherein the supply of thread is produced from a bobbin, and wherein the third means also stores a number of bobbins used and increases the number of bobbins used upon a user inputting to the first means an initial supply of thread.

4. The apparatus of claim 3 wherein the first means further allows a user to reset to zero each of the total consumed amount of thread and the number of bobbins used.

5. The apparatus of claim 1 wherein the first means includes a plurality of entry keys.

6. The apparatus of claim 1 wherein the first means further allows a user to input a pause command, and the third means stops calculating the consumed amount of thread in response thereto.

7. The apparatus of claim 1 wherein the thread is supplied from a bobbin, and the second means for providing a signal indicative of the rate of thread consumption is independent of rotation of the bobbin from which the thread is supplied.

8. The apparatus of claim 1 wherein the second means for providing a signal indicative of the rate of thread consumption includes a detector.

9. The apparatus of claim 1 wherein the second means for providing a signal indicative of the rate of thread consumption comprises:

a rotatable pulley for receiving the thread;

means for placing the thread under tension on the pulley such that the pulley rotates as the thread is consumed;

an encoding wheel coupled to the pulley and rotatable therewith; and a detector mounted adjacent to the encoding wheel for providing a signal indicative of the rate of thread consumption based upon the rotation of the encoding wheel.

10. The apparatus of claim 1 wherein:

a) the first means further allows a user to input at least one of a count-up command and a count-down command; and b) the third means produces a display signal indicative of the consumed amount of thread upon receipt of the count-up command, and a display signal indicative of the actual supply of thread upon receipt of the count-down command.

11. An apparatus for monitoring consumption of a supply of sewing thread comprising:

a) at least one input device for allowing a user to input the following:

i) an initial supply of thread, and ii) a minimum allowable supply of thread;

b) a detector for providing at least one signal indicative of a rate of thread consumption;

c) a control circuit coupled to the input device and the detector for:

i) receiving from the input device the initial supply and the minimum allowable supply, ii) receiving from the detector the signal indicative of the rate of thread consumption, iii) calculating a consumed amount of thread based at least upon the signal indicative of the rate of thread consumption, iv) calculating an actual supply of thread based at least upon the consumed amount and the initial supply, v) producing a display signal indicative of at least one of the actual supply and the consumed amount, and vi) producing an alarm signal when the actual supply of thread is approximately equal to or falls below the minimum allowable supply; and d)a display unit coupled to the control circuit for displaying one of the actual supply and the consumed amount upon receipt of the display signal from the control circuit.

12. The apparatus of claim 11 wherein the control circuit also stores a total amount of consumed thread.

13. The apparatus of claim 12 wherein the thread is supplied from a bobbin, and the control circuit stores a number of bobbins used, and increases the number of bobbins used in response to a user inputting an initial supply of thread using the input device.

14. The apparatus of claim 13 wherein the at least one input device allows a user to reset to zero each of the total consumed amount of thread and the number of bobbins used.

15. The apparatus of claim 11 wherein the at least one input device further allows a user to input a pause command, and wherein the control circuit stops calculating the consumed amount of thread in response thereto.

16. The apparatus of claim 11 wherein the thread is supplied from a bobbin, and the detector generates the at least one signal independent of rotation of the bobbin from which the thread is supplied.

17. The apparatus of claim 16 further comprising:

a rotatable pulley for receiving the thread;

means for placing the thread under tension on the pulley such that the pulley rotates as the thread is consumed; and an encoding wheel coupled to the pulley for rotation therewith; wherein the detector provides a signal indicative of the rate of thread consumption based upon rotation of the encoding wheel.

18. The apparatus of claim 11 wherein:

a) the at least one input device further allows a user to input at least one of a count-up command and a count-down command; and b) the control circuit produces a display signal indicative of the consumed amount of thread upon receipt of the count-up command, and a display signal indicative of the actual supply of thread upon receipt of the count-down command.

19. A method for monitoring consumption of a supply of sewing thread comprising:

a) receiving a signal indicative of an initial supply of thread;

b) receiving a signal indicative of minimum allowable supply of thread;

c) receiving a signal indicative of a rate of thread consumption;

d) calculating a consumed amount of thread based upon the rate of thread consumption;

e) calculating an actual supply of thread based upon the consumed amount and the initial supply;

f) producing a display signal indicative of at least one of the consumed amount and the actual supply; and g) producing a warning when the actual supply of thread is approximately equal to or less than the minimum allowable supply.

20. The method of claim 19 further comprising storing a total consumed amount of thread.

21. The method of claim 19 for use with a bobbin supplied thread, further comprising storing a number of bobbins used and increasing the number of bobbins used each time a signal indicative of an initial supply of thread is received.

22. The method of claim 19 for use with a bobbin supplied thread, wherein the signal indicative of the rate of thread consumption is received from a source independent of rotation of a bobbin from which the thread is supplied.

* * * * *